US006967614B1

(12) United States Patent
Wardell et al.

(10) Patent No.: US 6,967,614 B1
(45) Date of Patent: Nov. 22, 2005

(54) PROJECTILE LAUNCH DETECTION SYSTEM UTILIZING A CONTINUOUS WAVE RADIO FREQUENCY SIGNAL TO CONFIRM MUZZLE EXIT

(75) Inventors: Ronald G. Wardell, Ellicott City, MD (US); John I. Nickel, College Park, MD (US); Dennis W. Ward, Glenelg, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/709,448

(22) Filed: May 6, 2004

Related U.S. Application Data

(60) Provisional application No. 60/320,171, filed on May 7, 2003.

(51) Int. Cl.[7] ..... G01S 13/00

(52) U.S. Cl. ..... 342/60; 342/67; 342/68; 342/60; 342/13; 89/6; 89/6.5

(58) Field of Search ..... 342/13, 61; 89/6, 89/6.5

(56) References Cited

U.S. PATENT DOCUMENTS 3,958,241 A * 5/1976 Adrian ..... 342/16
4,360,812 A * 11/1982 Peperone ..... 342/128
4,649,796 A * 3/1987 Schmidt ..... 89/6.5
5,827,958 A * 10/1998 Sigler ..... 73/167

* cited by examiner

*Primary Examiner*—Thomas H. Tarcza
*Assistant Examiner*—Matthew M. Barker
(74) *Attorney, Agent, or Firm*—John F. Moran

(57) ABSTRACT

A projectile launch detection system utilizes a continuous wave radio frequency signal (CW/RF) to confirm muzzle exit. The projectile launch detection system can be used in smoothbore, fin-stabilized, non-air breathing projectiles. The gun tube appears as a waveguide to the projectile launch detection system during projectile launch. The projectile launch detection system transmits a CW/RF signal down the gun tube during launch of the projectile. A portion of the CW/RF signal is reflected back by an impedance mismatch at the boundary between the muzzle of the gun tube and free space. Upon exit by the projectile from the gun tube, an exit signature is detected that is defined by the impedance of the gun tube and by a ratio of the diameter of the gun tube to the frequency of the CW/RF signal. The projectile launch detection system processes the exit signature to detect a muzzle launch of the projectile from a specific gun tube.

13 Claims, 8 Drawing Sheets

PROJECTILE LAUNCH DETECTION SYSTEM UTILIZING A CONTINUOUS WAVE RADIO FREQUENCY SIGNAL TO CONFIRM MUZZLE EXIT

CROSS REFERENCE TO RELATED APPLICATIONS

This application claims benefit under 35 USC 119(e) of provisional application 60/320,171, filed May 7, 2003, the entire file wrapper contents of which provisional application are herein incorporated by reference as though fully set forth at length.

FEDERAL RESEARCH STATEMENT

The inventions described herein may be manufactured, used and licensed by or for the U.S. Government for U.S. Government purposes.

BACKGROUND OF INVENTION

1. Field of the Invention

The present invention generally relates to gun-launched projectiles, and in particular to a method for detecting a launch using a projectile borne continuous wave radio frequency signal in which the detection of the launch is used to arm a fuze in a gun-launched projectile.

2. Background of the Invention

Gun-launched projectiles utilize a safety and arming (S&A) device within a fuze to arm a projectile after launch. The projectile is considered armed when the fuze becomes armed after a valid gun launch is detected. The criterion for projectile fuze safety and arming is that a minimum of two independent launch environments or events must be confirmed before the projectile can be armed. Acceleration experienced by the projectile during launch (known as setback) and spin imparted to the projectile during launch are two environments detected and used for arming. Setback and spin exhibit robust and unique signatures that are easily detectable.

A conventional approach to detecting a valid gun launch utilizes mechanical inertial safety and arming devices. The mechanical inertial safety and arming devices are designed to observe and sense setback in excess of some pre-designed threshold as the first confirmation of gun launch. In projectiles in which spin is induced during launch, the mechanical inertial safety and arming devices are designed to observe and sense projectile spin in excess of some pre-designed threshold as the second confirmation of gun launch. However, fin-stabilized projectiles such as mortars and tank ammunition do not experience measurable spin during gun launch. Consequently, absence of spin stabilization requires the use of features of the launch environment other than spin to provide the necessary second safety signature for arming.

Conventional approaches for detecting the second safety signature have taken the form of detecting ram air pressure during flight, umbilical disconnect of an interface cable, or fin deployment once the projectile leaves the gun barrel. Although this technology has proven to be useful, it would be desirable to present additional improvements. The conventional approaches for detecting the second safety signature are difficult to implement on projectiles that do not or can not breathe air from the air stream during launch, use fixed-fin tail assemblies, or do not have an umbilical connection to a weapon platform. For projectiles that can breathe air from the air stream during launch, ports for diverting the air stream through the launch detector can become clogged, preventing operation of the second safety feature.

What is needed is a method for detecting a second safety signature of the launch of a projectile in conjunction with the detection of setback. This method for detecting the second safety signature should be applicable to projectiles such as those projectiles that do not breathe air from the air stream during launch, that use fixed-fin tail assemblies, that do not have an umbilical connection to a weapon platform, or that are not spin-stabilized. The need for such a system has heretofore remained unsatisfied.

SUMMARY OF INVENTION

A projectile launch detection system (referred to herein as "the system" or "the present system") utilizes a continuous wave radio frequency signal to confirm muzzle exit. The present system can be used in smoothbore, fin-stabilized, non-air breathing projectiles. The present system is encased entirely within the fuze housing. Furthermore, the present system utilizes the basic building blocks of a proximity sensor system. Consequently, the present system can serve a dual purpose of proximity sensing and launch detection. The present system is encapsulated, protecting the present system from the launch environment and improving performance reliability.

The present system exploits the basic scientific principles of electromagnetic wave propagation in a metallic structure or waveguide. The gun tube appears as a circular waveguide to the present system during projectile launch. The present system further exploits the behavior of an electromagnetic wave at a boundary between two different transmission media: the gun tube during projectile launch and free space on muzzle exit.

The present system transmits a continuous wave radio frequency signal down the gun tube during launch of the projectile. A portion of the continuous wave radio frequency signal is reflected back to the present system by an impedance mismatch at the boundary between the gun tube and free space at the muzzle of the gun tube. The present system processes the transmitted continuous wave radio frequency signal and the reflected continuous wave radio frequency signal to generate a pattern of coherent voltage maxima and minima (cycles). These cycles correspond to the length of the tube.

The cycles exhibit a change in frequency that corresponds to a change in velocity experienced by the projectile during launch. Upon exit by the projectile from the gun tube, an exit signature is detected that is defined by the impedance of the gun tube and by a ratio of the diameter of the gun tube to the frequency of the continuous wave radio frequency signal. The present system processes the number of cycles, frequency of cycles, and exit signature to detect a unique muzzle launch of the projectile from a specific gun tube.

BRIEF DESCRIPTION OF DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION

Figure 1:
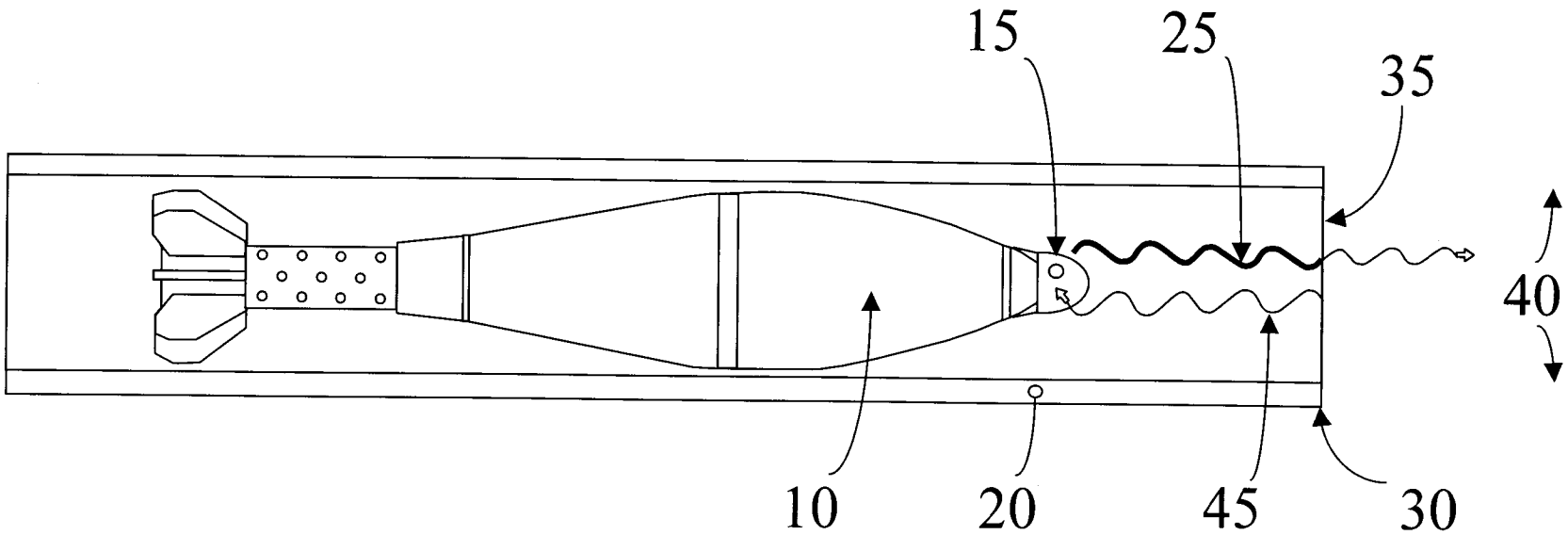
FIG. 1 is a cut away view of an exemplary projectile and gun tube in which a projectile launch detection system of the present invention can be used.
Figure 2:
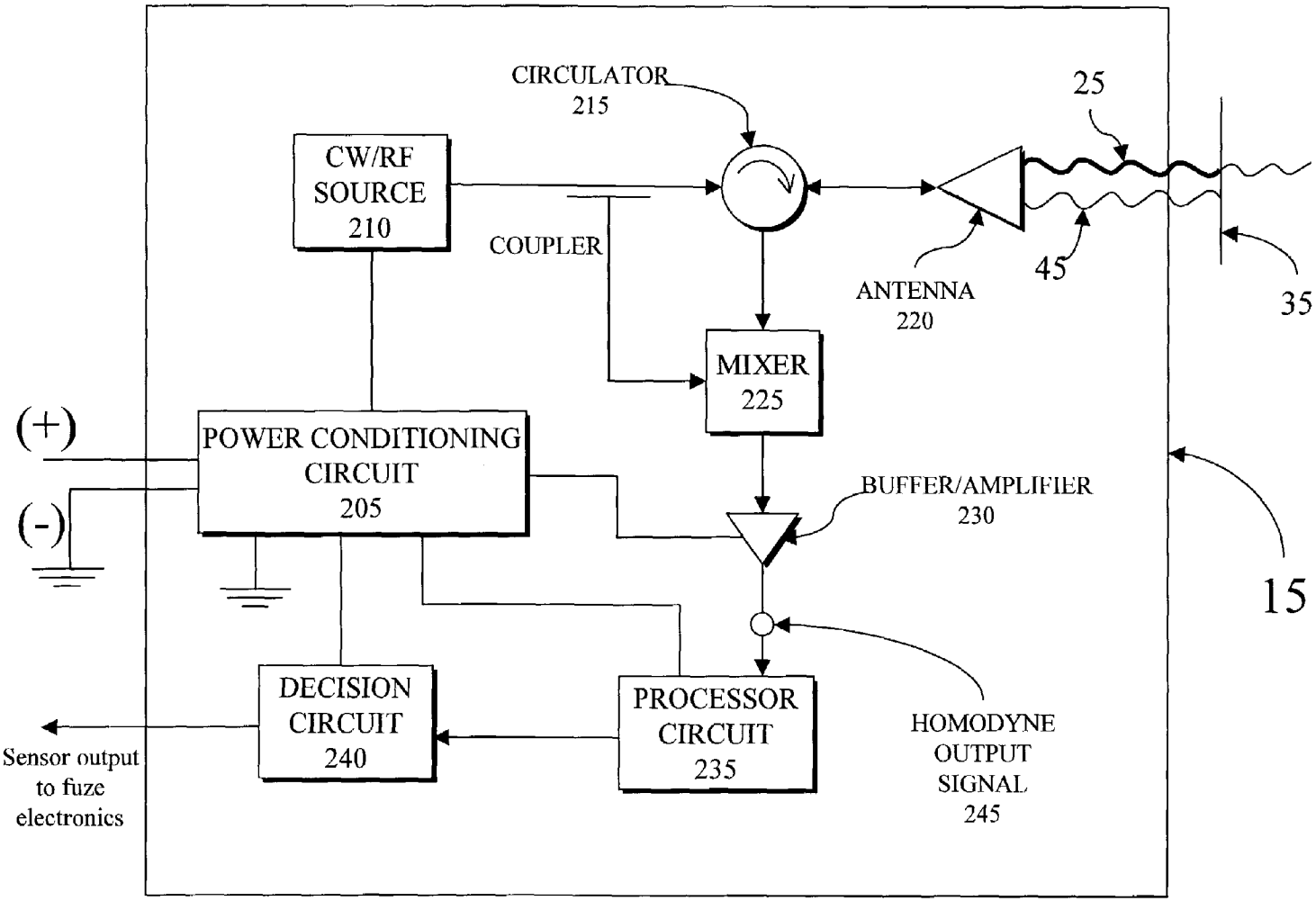
FIG. 2 is a block diagram of the high-level architecture of the projectile launch detection system of FIG. 1.

FIG. 1 illustrates an exemplary mortar projectile 10 (further referenced herein as projectile 10) comprising a projectile launch detection system 15 (further referenced herein as system 15) that utilizes a continuous wave radio frequency signal to detect a launch of projectile 10 from a gun tube 20. System 15 transmits a continuous wave radio frequency signal 25 down the gun tube 20 toward a muzzle 30 of the gun tube 20. Gun tube 20 appears to the continuous wave radio frequency signal 25 as a circular waveguide. A boundary 35 at the muzzle 30 between the gun tube 20 and free space 40 reflects a portion of the continuous wave radio frequency signal 25 as the reflected continuous wave radio frequency signal 45.

System 15 comprises a power supply 205, a continuous wave radio frequency (CW/RF) source 210, a circulator 215, an antenna 220, a mixer 225, a buffer/amplifier 230, a processing circuit 235, and a decision circuit 240. The power supply 205 supplies regulated electrical power to system 15. The CW/RF source 210 generates the continuous wave radio frequency signal 25 for transmission by system 15. System 15 is encapsulated and protected from the launch environment.

Circulator 215 directs the continuous wave radio frequency signal 25 from the CW/RF source 210 to antenna 220. Circulator 215 further directs the reflected continuous wave radio frequency signal 45 from the antenna 220 to mixer 225. Antenna 220 transmits the continuous wave radio frequency signal 25. Antenna 220 further receives the reflected continuous wave radio frequency signal 45. The reflected continuous wave radio frequency signal 45 has been reflected by an impedance mismatch at boundary 35 between the end of the gun tube 30 and free space 40 outside the gun tube 20.

Mixer 225 electrically mixes the reflected continuous wave radio frequency signal 45 received by antenna 220 with a sample of the continuous wave radio frequency signal 25 generated by the CW/RF source 210. Output of mixer 225 is a demodulated intermediate frequency (IF) signal supplied to the buffer/amplifier 230. The buffer/amplifier 230 isolates and amplifies the demodulated intermediate frequency signal, creating a homodyne output signal 245. The homodyne output signal 245 is the buffered and amplified intermediate frequency signal, representing an instantaneous sum of the transmitted continuous wave radio frequency signal 25 and the reflected continuous radio frequency signal 45.

The processing circuit 235 filters and analyzes the homodyne output signal 245. The decision circuit 240 determines whether the homodyne output signal 245 is a valid signal representing a launch from gun tube 20 or an invalid signal generated erroneously.

System 15 processes the transmitted continuous wave radio frequency signal 25 and the reflected continuous wave radio frequency signal 45 to generate a pattern of coherent voltage maxima and minima (cycles). These cycles correspond to the length of the tube.

The cycles exhibit a change in frequency that corresponds to a change in velocity experienced by projectile 10 during launch. Upon exit by projectile 10 from the gun tube 20, an exit signature is detected that is defined by the impedance of the gun tube 20 as a circular waveguide. The exit characteristic of projectile 10 is further defined by a ratio of the diameter of the gun tube 20 to the frequency of the continuous wave radio frequency signal 25. System 15 processes the number of cycles, frequency of cycles, and exit signature to detect a unique muzzle launch of projectile 10 from a specific gun tube 20.

Figure 3A:
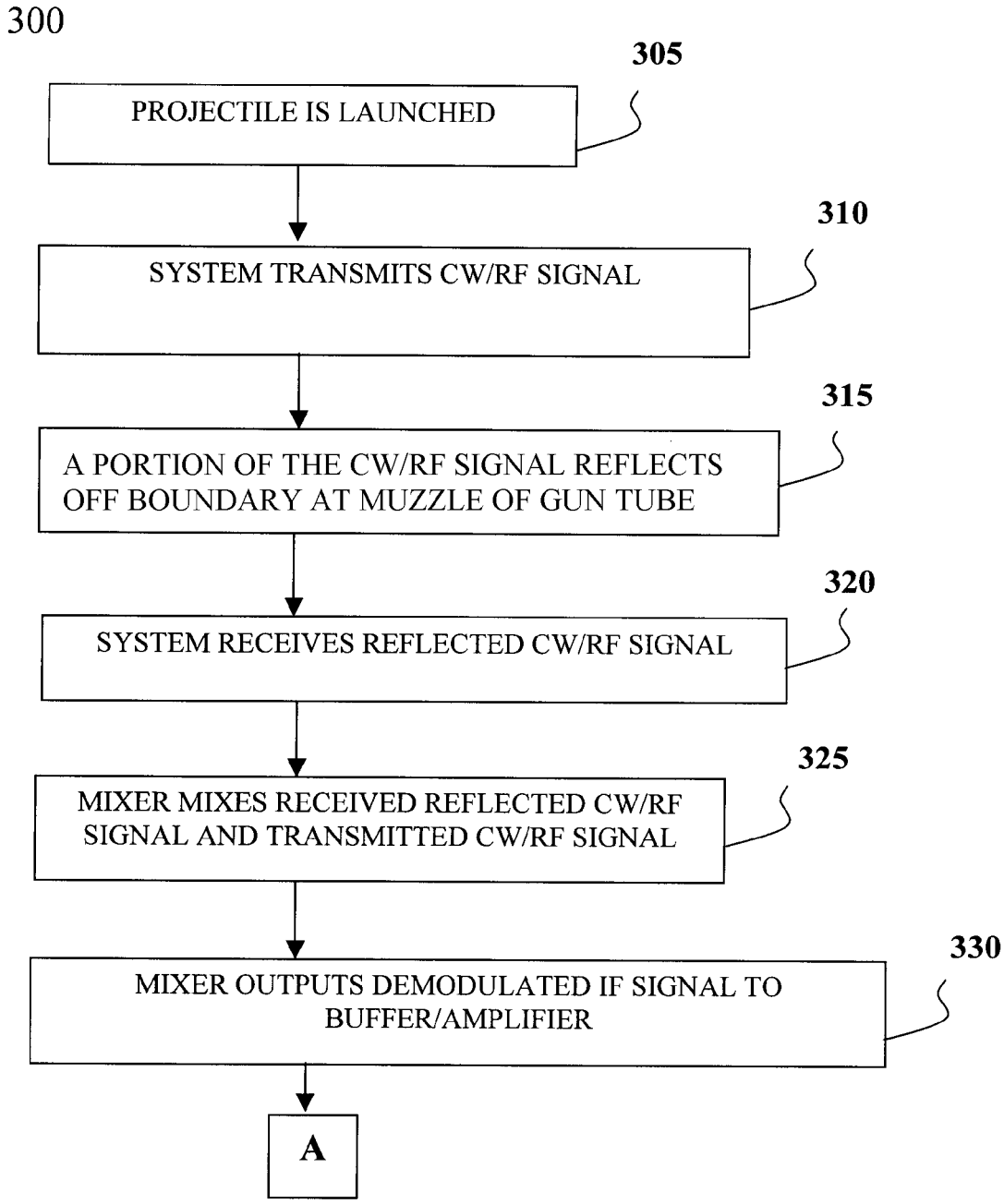
FIG. 3 is comprised of FIGS. 3A and 3B, and represents a process flow chart illustrating a method of operation of the projectile launch detection system of FIGS. 1 and 2.
Figure 3B:
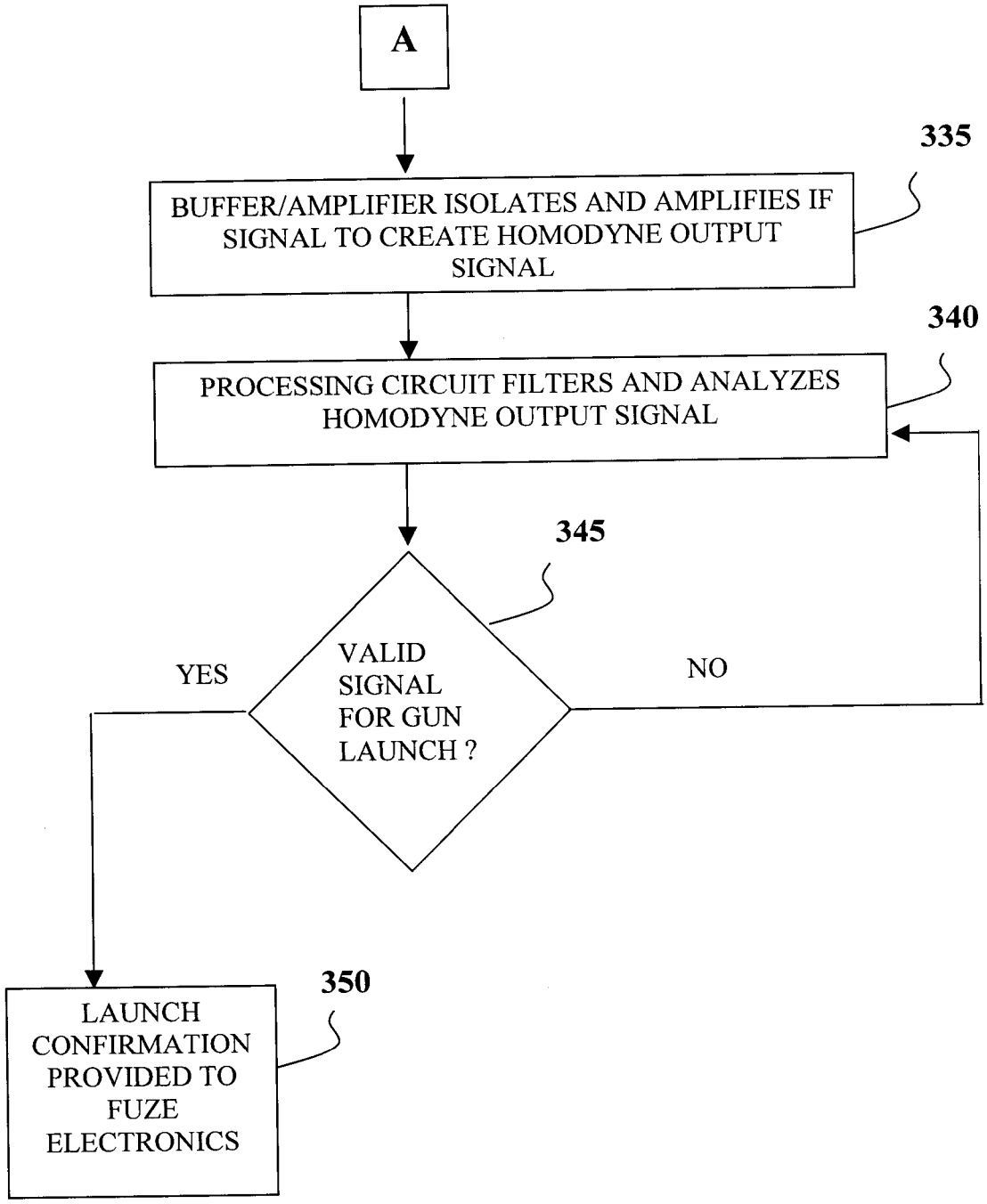

The flow chart of FIG. 3 (FIGS. 3A, 3B) illustrates a method of operation of system 15. Projectile 10 is launched at step 305. System 15 transmits the continuous wave radio frequency (CW/RF) signal 25 at step 310. The continuous wave radio frequency signal 25 transmitted by system 15 travels the length of the entire gun tube 20. A portion of the continuous wave radio frequency (CW/RF) signal 25 is reflected off boundary 35 back down the gun tube 20 toward projectile 10 and system 15 (step 315). System 15 receives the reflected continuous wave radio frequency (CW/RF) signal 45 at step 320.

Mixer 225 mixes the received reflected continuous wave radio frequency (CW/RF) signal 45 and the transmitted continuous wave radio frequency (CW/RF) signal 25 at step 325. Mixer 225 outputs the demodulated intermediate frequency (IF) signal to the buffer/amplifier 230 at step 330. The buffer/amplifier 230 isolates and amplifies the intermediate frequency (IF) signal to create the homodyne output signal 245 at step 335. The processing circuit 235 filters and analyzes the homodyne output signal 245 at step 340.

At decision step 345, the decision circuit determines whether the analysis by the processing circuit 235 provides a valid signal for a gun launch of projectile 10. If not, system 15 continues processing the continuous wave radio frequency signal 25 and the reflected continuous wave radio frequency signal 45, returning to step 340. If yes, system 15 provides a launch confirmation to the fuze electronics in projectile 10. A launch confirmation from system 15 in conjunction with another launch detection by, for example, a setback detection system is sufficient to enable arming the fuze of projectile 10.

Figure 4:
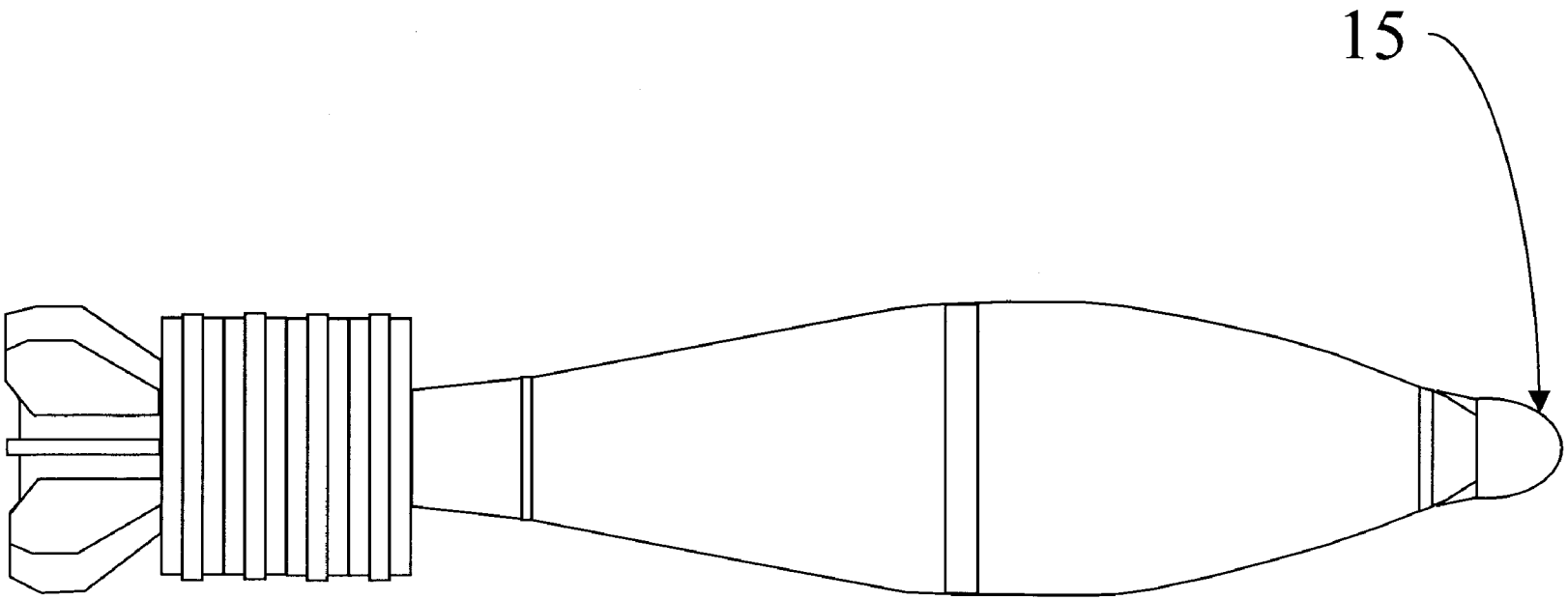
FIG. 4 is a view of an exemplary mortar projectile with a nose mounted fuze utilizing a launch detection system of FIGS. 1 and 2.
Figure 5:
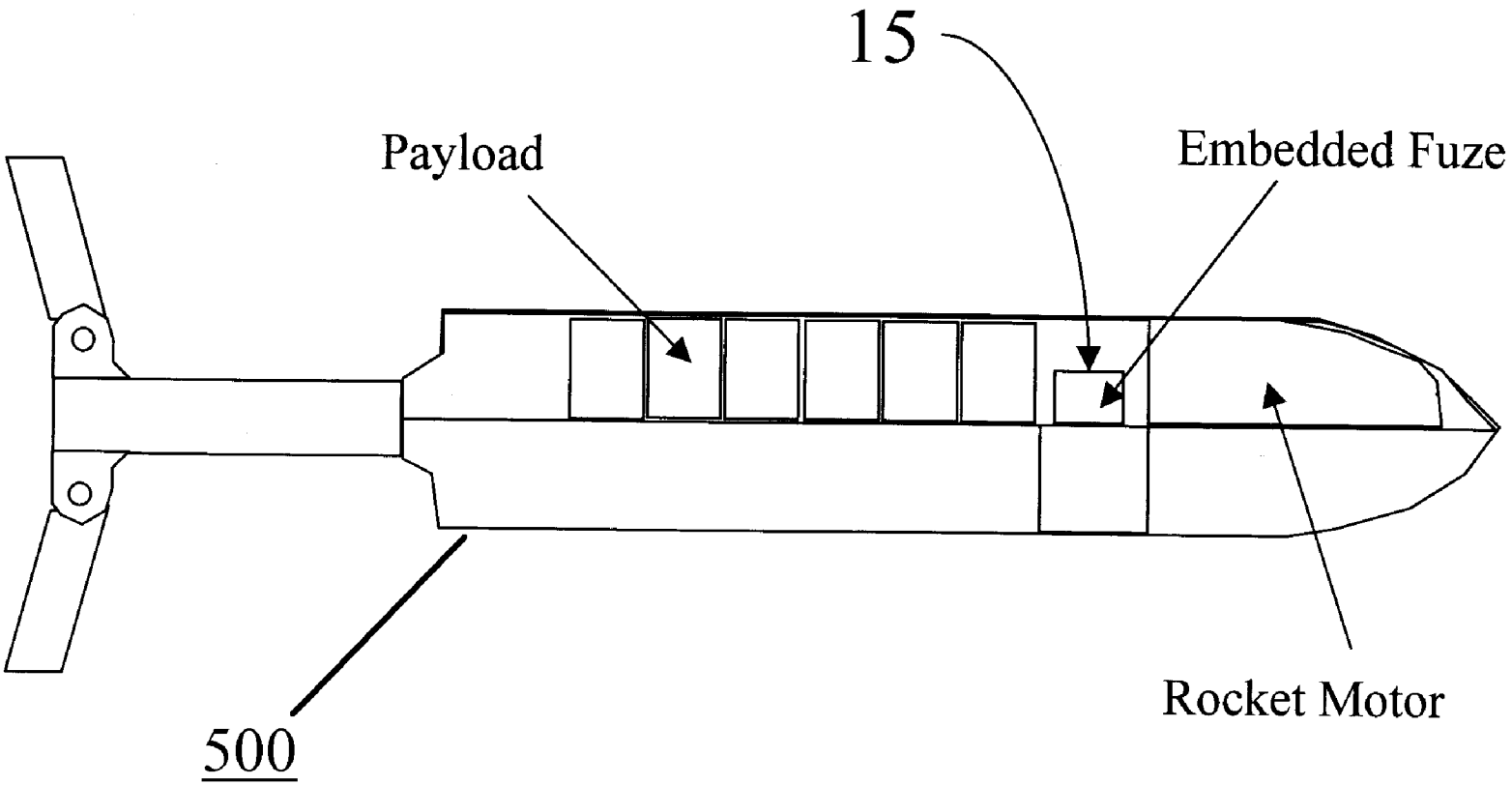
FIG. 5 is view of an exemplary guided projectile with an embedded fuze utilizing a launch detection system of FIGS. 1 and 2.
Figure 6:
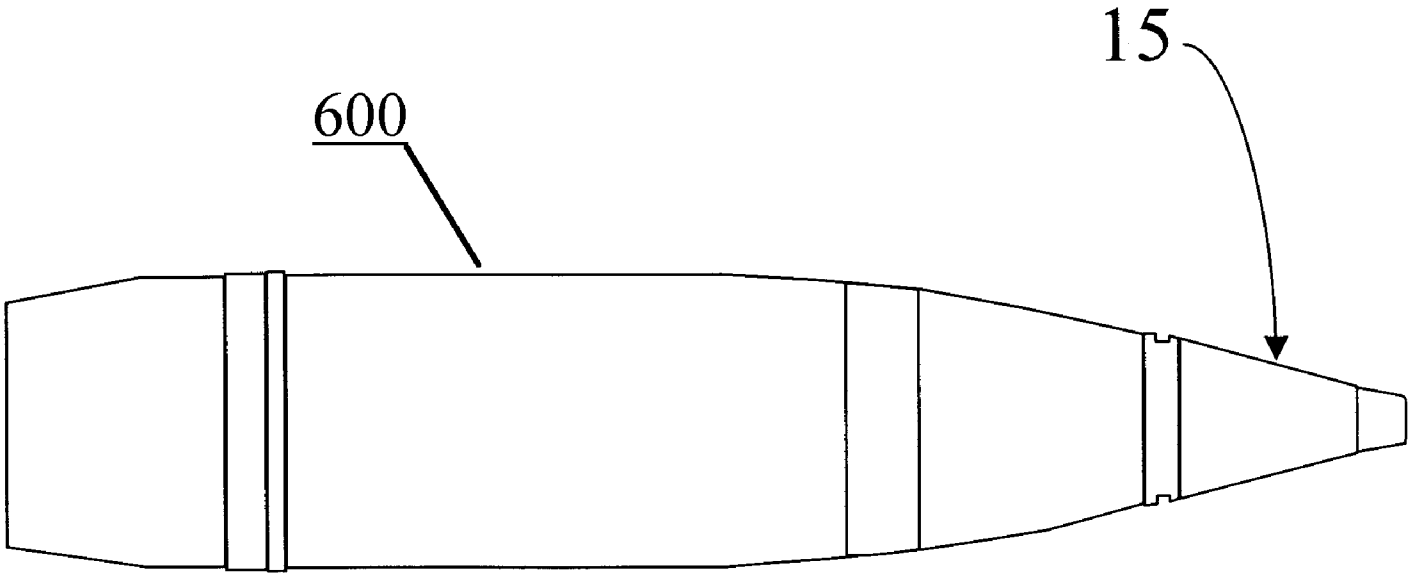
FIG. 6 is a view of an exemplary artillery projectile utilizing a launch detection system of FIGS. 1 and 2.
Figure 7:
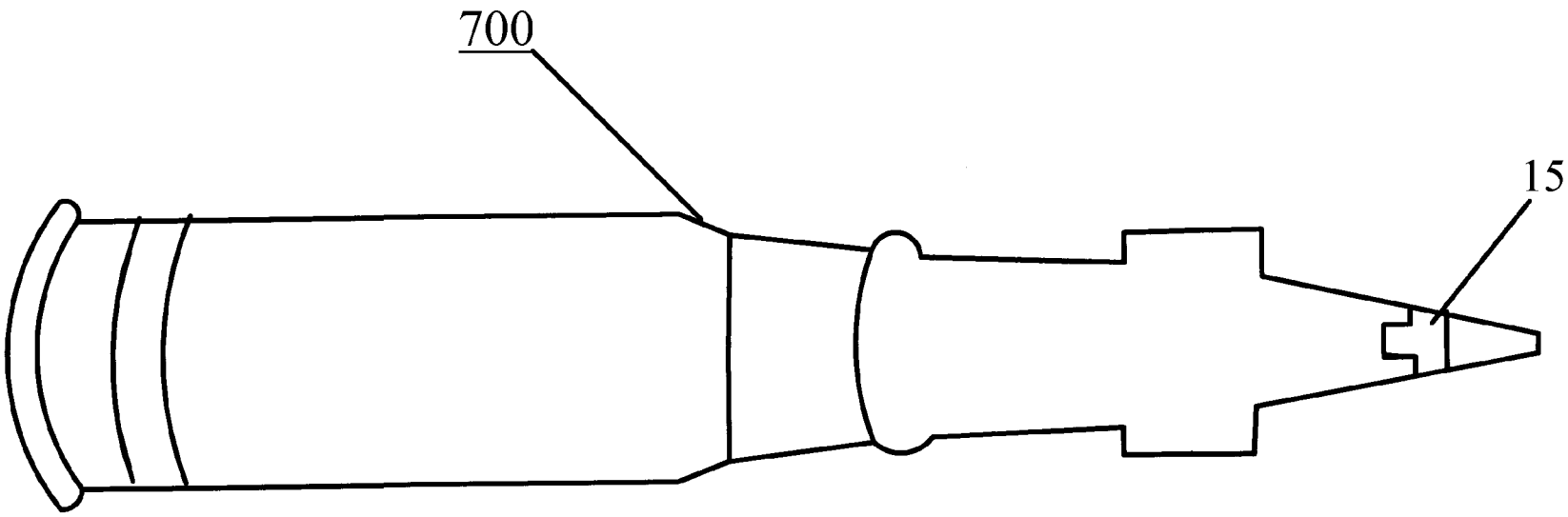
FIG. 7 is a view of an exemplary tank projectile utilizing a launch detection system of FIGS. 1 and 2.

System 15 may be used to provide launch confirmation in any projectile. For example, FIG. 4 illustrates a view of a mortar projectile 400 comprising system 15. FIG. 5 illustrates a view of a guided projectile with 500 comprising system 15. FIG. 6 illustrates a view of an artillery projectile 600 comprising system 15. FIG. 7 illustrates a tank projectile 700 incorporating system 15.

In an embodiment, system 15 utilizes a diode and an inductor to demodulate the intermediate frequency from the continuous wave radio frequency signal 25 rather than utilizing mixer 225 and a sample of the continuous wave radio frequency 25. In a further embodiment, the CW/RF source 210, circulator 215, mixer 225, and the buffer/amplifier 230 can be realized together as part of a monolithic microwave integrated circuit (MMIC). In yet another embodiment, an antenna diplexer circuit can be used as an alternative to circulator 215.

It is to be understood that the specific embodiments of the invention that have been described are merely illustrative of certain applications of the principle of the present invention. Numerous modifications may be made to a projectile launch detection system utilizing a continuous wave radio frequency signal to confirm muzzle exit described herein without departing from the spirit and scope of the present invention.

What is claimed is:

1. A projectile launch detection system utilizing a continuous wave radio frequency signal to confirm a muzzle exit of a projectile, the launch detection system comprising:

a continuous wave radio frequency source for generating a continuous wave radio frequency signal;

an antenna for transmitting a continuous wave radio frequency signal down a gun tube toward a boundary at a muzzle of the gun tube between the gun tube and free space;

the antenna receiving a reflected continuous wave radio frequency signal reflected from the boundary;

a mixer for generating a demodulated intermediate frequency signal from the transmitted continuous wave radio frequency signal transmitted and the reflected continuous wave radio frequency signal;

a buffer/amplifier for generating a homodyne signal from the demodulated intermediate frequency signal;

a processing circuit for performing an analysis of the de-modulated intermediate frequency signal; and a decision circuit for determining whether the analysis of the demodulated intermediate frequency signal constitutes a valid gun launch of the projectile.

2. The launch detection system of claim 1, wherein the gun tube appears as a circular wave guide of a specific characteristic impedance to the transmitted continuous wave radio frequency signal.

3. The launch detection system of claim 1, wherein the gun tube appears as the circular wave guide of a specific characteristic impedance to the reflected continuous wave radio frequency signal.

4. The launch detection system of claim 1, wherein the launch detection circuit is encapsulated and housed within the fuze for reliable performance during a launch of the projectile.

5. The launch detection system of claim 1, wherein the projectile is a large caliber tank projectile.

6. The launch detection system of claim 1, wherein the projectile is a mortar projectile.

7. The launch detection system of claim 1, wherein the projectile is an artillery projectile.

8. The launch detection system of claim 1, wherein the projectile is any projectile with fixed fins.

9. The launch detection system of claim 1, wherein the projectile is any projectile that does not breath air during launch.

10. The launch detection system of claim 1, wherein the projectile is any projectile launched from a smooth bore gun.

11. The launch detection system of claim 1, wherein launch detection circuit may also detect a proximity to a target.

12. The launch detection system of claim 1, wherein the demodulated intermediate frequency signal is demodulated by a diode and an inductor from the continuous wave radio frequency signal.

13. The launch detection system of claim 1, wherein a monolithic microwave integrated circuit performs a function of the continuous wave radio frequency source, the mixer, and the buffer/amplifier.

* * * * *